US006400345B1

(12) United States Patent
Ilcisin et al.

(10) Patent No.: US 6,400,345 B1
(45) Date of Patent: Jun. 4, 2002

(54) METHOD OF OPERATING A PLASMA ADDRESSED LIQUID CRYSTAL (PALC) PANEL

(75) Inventors: Kevin J. Ilcisin; Thomas S. Buzak, both of Beaverton, OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 09/340,540

(22) Filed: Jun. 28, 1999

Related U.S. Application Data

(60) Provisional application No. 60/091,723, filed on Jul. 6, 1998.

(51) Int. Cl.[7] ..... G09G 3/28

(52) U.S. Cl. ..... 345/63; 345/60; 345/61; 345/62; 345/64; 345/65; 345/66; 345/67; 345/68; 345/69; 345/87

(58) Field of Search ..... 345/60, 61, 62, 345/63, 64, 65, 66, 67, 68, 69, 87

(56) References Cited

U.S. PATENT DOCUMENTS 5,210,469 A * 5/1993 Kim ..... 315/369.4
5,948,228 A * 9/1999 Hinchliffe et al. ..... 204/485
6,016,032 A * 1/2000 Buzak et al. ..... 313/493

* cited by examiner

*Primary Examiner*—Richard Hjerpe
*Assistant Examiner*—Jean Lesperance
(74) *Attorney, Agent, or Firm*—John D. Winkelman; John Smith-Hill

(57) ABSTRACT

A PALC panel is operated by increasing the voltage between the channel electrodes to a firing voltage to create a plasma in the channel, reducing the voltage between the channel electrodes to a sustaining voltage to sustain the plasma for an interval during which a selected drive voltage is applied to the data drive electrode to establish an electric field in the layer of electro-optic material, and reducing the voltage between the channel electrodes to a bias voltage, which is insufficient to sustain the plasma but provides an electric field having a component parallel to the cover sheet in the layer of electro-optic material.

2 Claims, 2 Drawing Sheets

METHOD OF OPERATING A PLASMA ADDRESSED LIQUID CRYSTAL (PALC) PANEL

CROSS REFERENCED TO RELATED APPLICATIONS

This application claims the benefit of U.S. Provisional Application No. 60/091,723, filed Jul. 6, 1998.

BACKGROUND OF THE INVENTION

This invention relates to a method of operating a plasma addressed liquid crystal (PALC) panel.

U.S. Pat. No. 5,077,553 discloses apparatus for addressing data storage elements. A practical implementation of the apparatus shown in U.S. Pat. No. 5,077,553 is illustrated schematically in FIG. 1 of the accompanying drawings.

The display panel shown in FIG. 1 comprises, in sequence from below, a polarizer 2, a channel member 4, a cover sheet 6 (commonly known as a microsheet), a layer 10 of electro-optic material, an array of parallel transparent data drive electrodes (only one of which, designated 12, can be seen in the view shown in FIG. 1), an upper substrate 14 carrying the data drive electrodes, and an upper polarizer 16. In the case of a color display panel, the panel includes color filters (not shown) between the layer 10 and the upper substrate 14. The panel may also include layers for improving viewing angle and for other purposes. The channel member 4 is typically made of glass and is formed with multiple parallel channels 20 in its upper main face. The channels 20, which are separated by ribs 22, are filled with an ionizable gas, such as helium. An anode 24 and a cathode 26 are provided in each of the channels 20. The channels 20 are orthogonal to the data drive electrodes and the region where a data drive electrode crosses a channel (when viewed perpendicularly to the panel) forms a discrete panel element 28. Each panel element can be considered to include elements of the layer 10 and the lower and upper polarizers 2 and 16. The region of the upper surface of the display panel that bounds the panel element constitutes a single pixel 30 of the display panel.

When the anode 24 in one of the channels is connected to a reference potential and a suitably more negative voltage is applied to the cathode 26 in that channel, the gas in the channel forms a plasma which provides a conductive path to the reference potential at the lower surface of the cover sheet 6. If a data drive electrode is at the reference potential, there is no significant electric field in the volume element of electro-optic material in the panel element at the crossing of the channel and the data drive electrode and the panel element is considered to be off, whereas if the data drive electrode is at a substantially different potential from the reference potential, there is a substantial electric field in that volume element of electro-optic material and the panel element is considered to be on.

It will be assumed in the following description, without intending to limit the scope of the claims, that the lower polarizer 2 is a linear polarizer and that its plane of polarization can be arbitrarily designated as being at 0° relative to a reference plane, that the upper polarizer 16 is a linear polarizer having its plane of polarization at 90°, and that the electro-optic material rotates the plane of polarization of linearly polarized light passing therethrough by an angle which is a function of the electric field in the electro-optic material. When the panel element is off, the angle of rotation is 90°; and when the panel element is on, the angle of rotation is zero.

The panel is illuminated from the underside by an extended light source 34 which emits unpolarized white light. A rear glass diffuser 18 having a scattering surface may be positioned between the light source and the panel in order to provide uniform illumination of the panel. The light that enters a given panel element from the source is linearly polarized at 0° by the lower polarizer 2 and passes sequentially through the channel member 4, the channel 20, the cover sheet 6, and the volume element of the electro-optic material toward the upper polarizer 16 and a viewer 32. If the panel element is off, the plane of polarization of linearly polarized light passing through the volume element of electro-optic material is rotated through 90°, and therefore the plane of polarization of light incident on the upper polarizer element is at 90°. The light is passed by the upper polarizer element and the pixel is illuminated. If, on the other hand, the panel element is on, the plane of polarization of the linearly polarized light is not changed on passing through the volume element of electro-optic material. The plane of polarization of light incident on the upper polarizer element is at 0° and therefore the light is blocked by the upper polarizer element and the pixel is dark. If the electric field in the volume element of electro-optic material is intermediate the values associated with the panel element being off and on, light is passed by the upper polarizer element with an intensity which depends on the electric field, allowing a gray scale to be displayed.

In a practical implementation of the PALC display panel, the channel member 4 is etched back around the area in which the channels are formed in order to provide a plateau 36 in which the channels 20 are formed, and the cover sheet 6 is secured to the channel member by an endless frit bead 38 in a rabbet 40 extending around the periphery of the plateau. An upper substrate assembly, including the upper substrate 14 and the data drive electrodes 12 carried thereby, is attached to the channel member 4 by means of a glue bead 42.

When the PALC display panel disclosed in U.S. Pat. No. 5,077,553 is used as a raster scan display panel for displaying a raster scan video signal, the panel is oriented so that the channels extend horizontally and the data drive electrodes. extend vertically. The horizontal line interval can conveniently be divided into an initiation interval, during which the plasma is formed in the channel; a sustain interval, during which the voltage of the strobe pulse is less than during the initiation interval but is sufficient to sustain the plasma; and a decay interval, which starts when the strobe pulse is removed and during which the gas reverts to its non-conductive state.

The data drive electrodes are driven to the voltage levels associated with line N+1 of the video signal during a capture interval which starts after the end of the decay interval of line N and ends before the end of the sustain interval of line N+1, so that the data drive electrodes are at the proper levels at the end of the sustain interval for line N+1 but the change in voltage levels, from the levels for line N to the levels for line N+1, does not affect the panel elements of line N.

In the conventional PALC panel, the electro-optic material may be a liquid crystal material operating in a twisted nematic (TN) mode. The upper surface of the cover sheet is provided with an alignment layer oriented parallel to the plane of polarization of the lower polarizer 2 (0°) and the lower surface of the data drive electrode 12 is provided with an alignment layer oriented parallel to the plane of polarization of the upper polarizer 16 (90°). The molecules that are in contact with the alignment layers are aligned with the respective alignment layers. When the display element is off, and there is no significant electric field in the volume element of liquid crystal material, the molecules that are distant from the alignment layers tend to align themselves with their neighboring molecules. Therefore, the axes of the molecules are generally parallel to the upper surface of the cover sheet and the orientation of the liquid crystal molecules spirals through the range from 0° to 90° as a function of distance from the lower alignment layer to the upper alignment layer. When linearly polarized light passes through the liquid crystal material, its plane of polarization rotates by 90°.

When there is an electric field in the volume element of liquid crystal material, the axes of the liquid crystal molecules tend to become aligned with the electric field. When there is a potential difference between the data drive electrode and the channel electrodes, the electric field tends to force the liquid crystal molecules to an alignment perpendicular to the upper surface of the cover sheet, against the constraints imposed by the alignment layers. The orderly spatial arrangement imposed by the alignment layers is disrupted to an extent that depends on the potential difference, and the angle through which the plane of polarization of linearly polarized light rotates when passing through the liquid crystal material is reduced.

M. Oh-e, M. Ohta, S. Aratani and K. Kondo, *Principles and Characteristics of Electro-Optical Behavior with In-Plane Switching Mode*, ASIA Display '95, 577, 1995, describes operation of a liquid crystal display in an alternative mode, known as the in-plane switching mode. In this paper, the principle of in-plane switching is discussed in the context of a liquid crystal cell which is bounded by upper and lower plates having parallel alignment layers and wherein there are two spaced parallel electrodes in the cell on the lower plate extending at 45° to the alignment direction of the alignment layers. When there is a potential difference between the electrodes, an electric field having a component perpendicular to the length of the electrodes is created in the space between the plates. The liquid crystal molecules that are distant from the alignment layers tend to become aligned parallel to the electrodes.

An advantage of the in-plane switching mode of operation of a liquid crystal display is that viewing angle characteristics are improved relative to a similar display operating in the TN mode.

SUMMARY OF THE INVENTION

In accordance with a first aspect of the invention there is provided an improved method of operating a PALC panel which comprises a channel member defining at least one channel, an ionizable gas in the channel, channel electrodes exposed to the ionizable gas in the channel, a cover sheet over the channel, a data drive electrode in crossing relationship with the channel, and a layer of electro-optic material between the data drive electrode and the cover sheet, wherein the voltage between the channel electrodes is increased to a firing voltage to create a plasma in the channel, the voltage between the channel electrodes is reduced to a sustaining voltage to sustain the plasma for an interval during which a selected drive voltage is applied to the data drive electrode to establish an electric field in the layer of electro-optic material, and the voltage between the channel electrodes is reduced to a level that is insufficient to sustain the plasma, and the improvement comprises maintaining a residual bias voltage between the channel electrodes after reducing the voltage to a level insufficient to sustain the plasma, whereby an electric field having a component parallel to the cover sheet is created in the layer of electro-optic material.

In accordance with a second aspect of the invention there is provided an improved PALC panel of the kind comprising a channel member defining at least one channel, an ionizable gas in the channel, channel electrodes exposed to the ionizable gas in the channel, a cover sheet over the channel, a data drive electrode in crossing relationship with the channel, a layer of electro-optic material between the data drive electrode and the cover sheet, and a channel electrode driver which increases the voltage between the channel electrodes to a firing voltage to create a plasma in the channel, reduces the voltage between the channel electrodes to a sustaining voltage to sustain the plasma for an interval during which a selected drive voltage is applied to the data drive electrode to establish an electric field in the layer of electro-optic material, and reduces the voltage between the channel electrodes to a level that is insufficient to sustain the plasma, wherein the improvement resides in that the channel electrode driver maintains a residual bias voltage between the channel electrodes after reducing the voltage to a level insufficient to sustain the plasma, whereby an electric field having a component parallel to the cover sheet is created in the layer of electro-optic material.

BRIEF DESCRIPTION OF THE DRAWINGS

For a better understanding of the invention, and to show how the same may be carried into effect, reference will now be made, by way of example, to the accompanying drawings, in which.

In the several figures of the drawings, like reference numerals are used to designate corresponding elements.

DETAILED DESCRIPTION

Figure 3A:
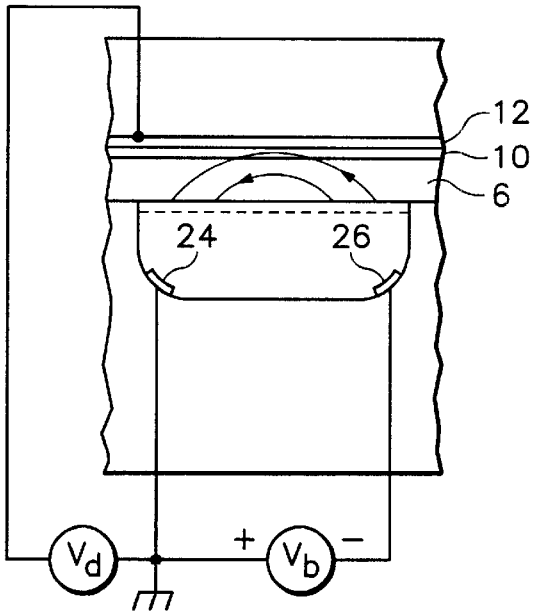
FIG. 3A is a schematic view of a panel element of a PALC display panel in accordance with the invention, illustrating operation at a first data drive voltage.
Figure 3B:
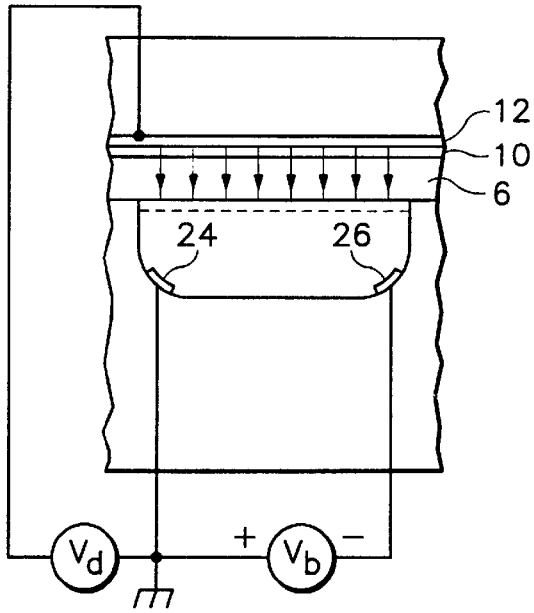
FIG. 3B is a schematic view of a panel element of a PALC display panel in accordance with the invention, illustrating operation at a second data drive voltage.

In the PALC display panel shown in FIGS. 3A and 3B, 0° is parallel to the longitudinal extent of the channels, the plane of polarization of the upper polarizer is at 0° and the alignment layers on the upper side of the cover sheet and on the lower side of the data drive electrodes are oriented at 90°.

Figure 1:
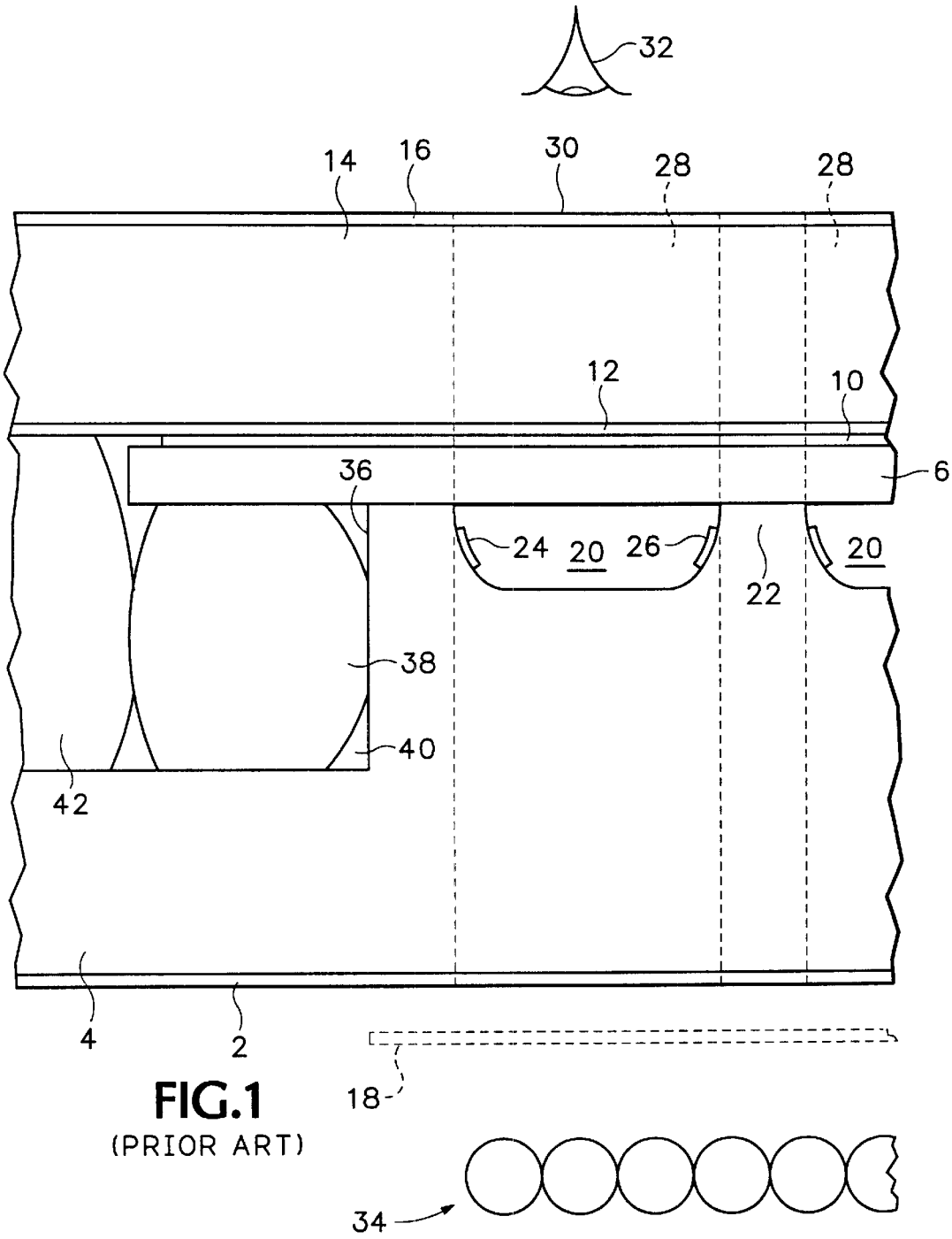
FIG.1 (PRIOR ART)
FIG. 1 is a partial sectional view of a PALC display panel in accordance with the prior art.
Figure 2:
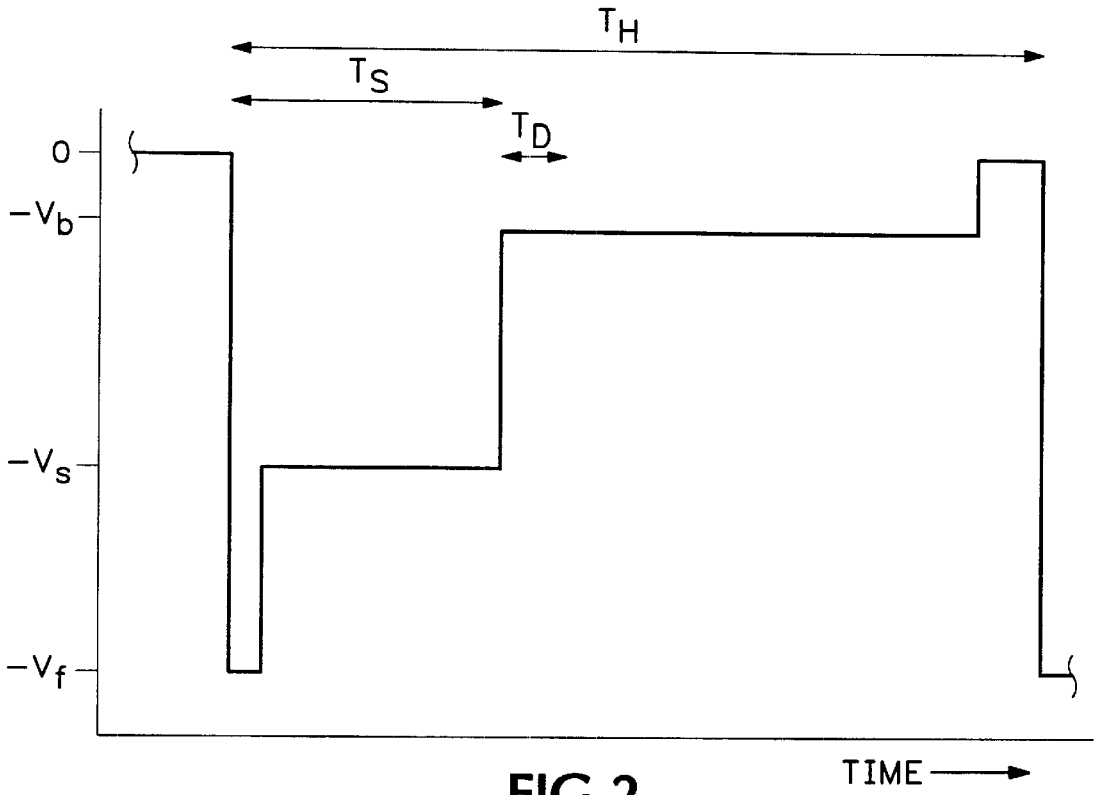
FIG. 2 is graph illustrating operation of a PALC display panel in accordance with the invention.

Referring to FIG. 2, during a horizontal line interval $T_H$ of the video signal, the cathode 26 is initially driven to a voltage $-V_f$ for firing the plasma and is then driven to a less negative voltage $-V_s$ to sustain the plasma for a sustain interval $T_s$. At the end of the sustain interval $T_s$, the cathode is held at a small bias voltage, which is shown in FIG. 2 as a negative voltage $-V_b$. The bias voltage is insufficient to sustain the plasma and accordingly the plasma decays over a brief decay interval $T_D$ and becomes non-conductive. Depending on the gas employed in the channel, the plasma decays in 1–30 $\mu$s after removal of the sustain voltage.

During the decay interval, a sheath layer of charged particles is formed on the dielectric surfaces bounding the plasma channel. The layer of sheath charge is infinitesimally thin and is distributed over a finite distance in the direction parallel to the data drive electrodes. The bias voltage results in the distribution of the sheath charge on the underside of the cover sheet being non-uniform, such that the potential at the underside of the cover sheet increases in the direction from the cathode toward the anode.

The data drive electrode 12 is driven to a voltage $V_d$ at the time the plasma is initiated and remains at that voltage until some time before the end of the horizontal line time of the video signal.

The data drive voltage $V_d$ and the non-uniform sheath charge distribution create an electric field which penetrates the volume element of liquid crystal material. It is convenient to discuss this electric field in terms of a component $E_{\|}$ parallel to the longitudinal extent of the data drive electrodes and a component $E_{\perp}$ perpendicular to the cover sheet.

It will be appreciated by those skilled in the art that the relative magnitudes of the field components $E_{\|}$ and $E_{\perp}$ depend on the magnitude of the data drive voltage. If the data drive voltage $V_d$ is small, e.g. its magnitude is less than about 10 volts, the component $E_{\|}$ in the volume element of liquid crystal material is much greater than the component $E_{\perp}$ (FIG. 3A) whereas if the data drive voltage is substantially greater, the component $E_{\perp}$ is greater than the component $E_{\|}$. When the data drive voltage is small, and the component $E_{\|}$ is much greater than the component $E_{\perp}$, the liquid crystal molecules are aligned with the field component $E_{\|}$. The force aligning the molecules exists not only at the alignment layers bounding the volume element of liquid crystal material but also in the space between the alignment layers, and therefore the field component reinforces the effect of the alignment layers. The volume element of liquid crystal material blocks propagation of light polarized at 0°. When the data drive voltage is large, and the component $E_{\perp}$ is much greater than the component $E_{\|}$, alignment of the liquid crystal molecules will be disrupted to an extent that depends on the voltage $V_d$ and light polarized at 0° is passed by the volume element of liquid crystal material to an extent that depends on the data drive voltage.

It will therefore be seen that by maintaining the bias voltage $V_b$ between the channel electrodes, an in-plane switching mechanism, according to which alignment of the liquid crystal molecules in the off state is maintained by a parallel electric field component, is applied to a PALC panel.

It will be appreciated that the invention is not restricted to the particular embodiment that has been described, and that variations may be made therein without departing from the scope of the invention as defined in the appended claims and equivalents thereof.

What is claimed is:

1. An improved method of operating a PALC panel which comprises a channel member defining at least one channel, an ionizable gas in the channel, channel electrodes exposed to the ionizable gas in the channel, a cover sheet over the channel, a data drive electrode in crossing relationship with the channel, and a layer of electro-optic material between the data drive electrode and the cover sheet, wherein the voltage between the channel electrodes is increased to a firing voltage to create a plasma in the channel, the voltage between the channel electrodes is reduced to a sustaining voltage to sustain the plasma for an interval during which a selected drive voltage is applied to the data drive electrode to establish an electric field in the layer of electro-optic material, and the voltage between the channel electrodes is reduced to a level that is insufficient to sustain the plasma, and the improvement comprises maintaining a residual bias voltage between the channel electrodes after reducing the voltage to a level insufficient to sustain the plasma, whereby an electric field having a component parallel to the cover sheet is created in the layer of electro-optic material.

2. An improved PALC panel of the kind comprising a channel member defining at least one channel, an ionizable gas in the channel, channel electrodes exposed to the ionizable gas in the channel, a cover sheet over the channel, a data drive electrode in crossing relationship with the channel, a layer of electro-optic material between the data drive electrode and the cover sheet, and a channel electrode driver which increases the voltage between the channel electrodes to a firing voltage to create a plasma in the channel, reduces the voltage between the channel electrodes to a sustaining voltage to sustain the plasma for an interval during which a selected drive voltage is applied to the data drive electrode to establish an electric field in the layer of electro-optic material, and reduces the voltage between the channel electrodes to a level that is insufficient to sustain the plasma, wherein the improvement resides in that the channel electrode driver maintains a residual bias voltage between the channel electrodes after reducing the voltage to a level insufficient to sustain the plasma, whereby an electric field having a component parallel to the cover sheet is created in the layer of electro-optic material.

* * * * *